United States Patent [19]

Burns et al.

[11] 4,265,413

[45] May 5, 1981

[54] TAKE-UP APPARATUS FOR ELECTRICAL PHASE INSULATOR FABRICATING EQUIPMENT

[75] Inventors: Richard D. Burns; Albert J. Wesseldyk, both of Holland, Mich.

[73] Assignee: General Electric Company, Fort Wayne, Ind.

[21] Appl. No.: 125,123

[22] Filed: Feb. 27, 1980

[51] Int. Cl.[3] ..... B65H 23/16

[52] U.S. Cl. ..... 242/75.3; 242/67.1 R

[58] Field of Search ..... 242/75.3, 67.1 R, 67.2, 242/67.3 R, 75; 29/596

[56] References Cited

U.S. PATENT DOCUMENTS

| | | | |
|---|---|---|---|
| 1,085,260 | 1/1914 | Holden | 242/75.3 |
| 1,946,264 | 2/1934 | Baer | 242/75.3 |
| 2,648,504 | 8/1953 | Ertner | 242/75.3 |
| 2,681,184 | 6/1954 | Thomas | 242/75.3 X |

*Primary Examiner*—Edward J. McCarthy
*Attorney, Agent, or Firm*—Ralph E. Krisher, Jr.

[57] ABSTRACT

Take-up apparatus for phase insulator fabrication equipment. A take-up reel is mounted at the exit end of the equipment in properly aligned and squared relationship to the fabricated phase insulator belt and is driven in a continuously rotating mode alternately at high and slow speeds. The fabricated belt forms a downwardly depending loop into the trough of which is laid a constant mass adjustable width shaped somewhat like a dumbbell in form. The tension roll has two cylindrical end weights adjustably positioned onto a grooved connecting rod. The positioning of the end weights is adjustable to accommodate fabricated phase insulator belts of different widths without changing the weight of the tension roll thus assuring proper tensioning of the accumulated belt roll on the reel irrespective of the width of the belt being accumulated.

6 Claims, 6 Drawing Figures

FIG. 3
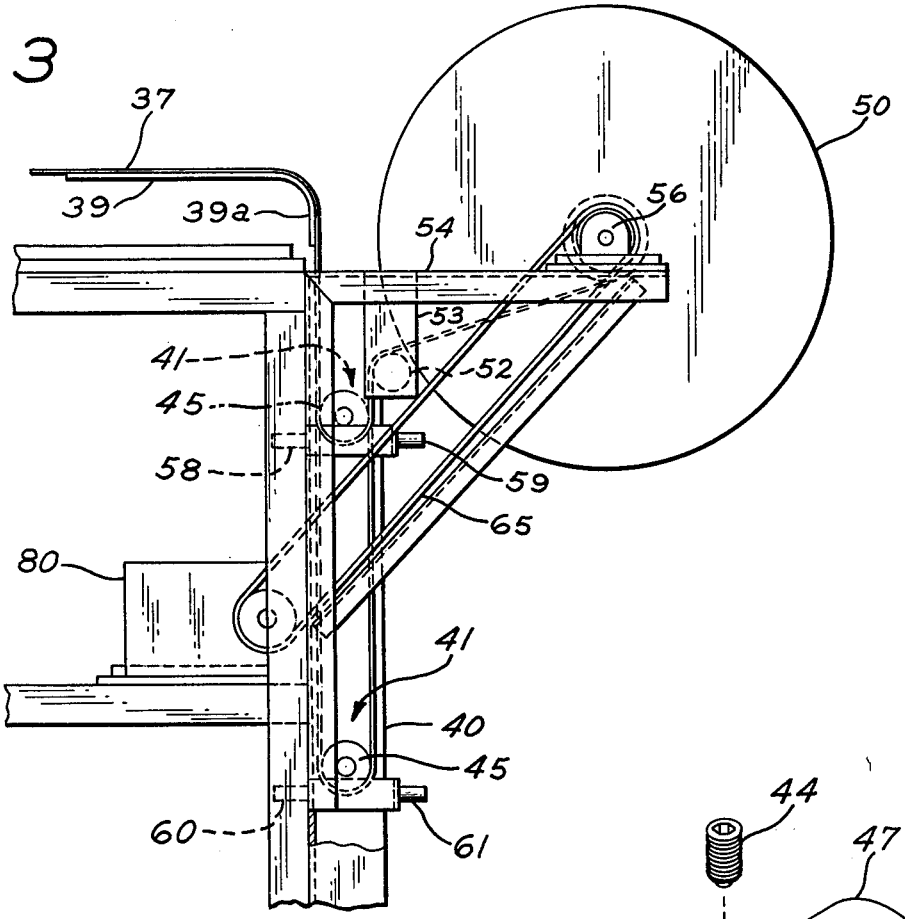
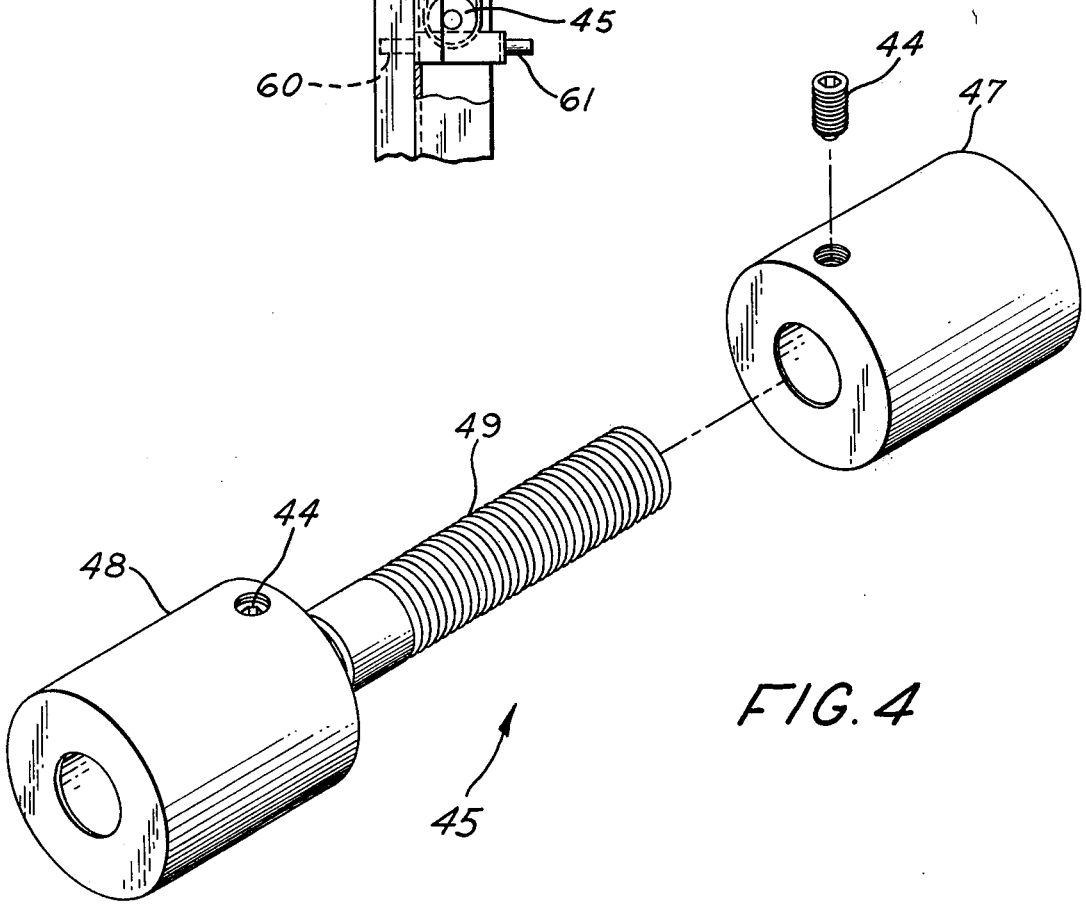
FIG. 4

TAKE-UP APPARATUS FOR ELECTRICAL PHASE INSULATOR FABRICATING EQUIPMENT

CROSS-REFERENCE TO RELATED APPLICATION

This application is related to co-pending application Ser. No. 8,603, filed Feb. 1, 1979, in the name of Richard D. Burns and entitled "Dynamoelectric Machine Phase Insulators and Apparatus and Methods for Making the Same." This application is also related to co-pending application, Ser. No. 051,029, filed June 22, 1979, jointly in the names of Richard D. Burns and Albert J. Wesseldyk, and entitled "Methods and Apparatus for Fabricating Electrical Phase Insulators for Dynamoelectric Machines." The entire disclosure of these related applications are hereby specifically incorporated herein by reference.

BACKGROUND OF THE INVENTION

The present invention relates to apparatus for manufacturing electrical phase insulators for dynamoelectric machines and more specifically to take-up apparatus for accumulating in reel form a continuous belt of interconnected phase insulators. In fabricating phase insulators for dynamoelectric machines of the type shown in the aforementioned application, Ser. No. 8,603, utilizing automated fabrication equipment as shown in the aforementioned application, Ser. No. 051,029, a continuous belt of phase insulators is provided which may be cut up into separate phase insulators or else accumulated on a take-up reel for subsequent use on an automatic phase insulation insertion machine. Phase insulators and their method of use in providing insulation between end turns of adjacent field windings in a dynamoelectric machine are well known. The details of representative phase insulators and the manner in which they can be inserted using automated equipment is shown in co-pending application, Ser. No. 918,055, now U.S. Pat. No. 4,216,571, filed June 22, 1978, jointly in the names of Sammy L. Miller and Alan L. Kindig, and entitled "Methods and Apparatus for Inserting Winding End Turn Phase Insulation." When utilizing fabricated phase insulators with automated insertion machinery, it is convenient and desirable to provide the phase insulators in the form of a continuous belt of longitudinally interconnected phase insulators. The automated insertion machinery operates, in part, to unreel the belt of phase insulators and to sever them into separate phase insulators for insertion in the dynamoelectric machines.

The phase insulator belt to which the present invention is adapted comprises a pair of spaced apart, parallel planer insulator strips cross-connected by, for example, filamentary cross-connector strips thus forming a series of rectangular windows framed by the planer insulator strips and by adjacent cross-connector strips. It will be appreciated that the length of the cross-connector strips and, consequently, the width of the phase insulator belt is determined by the lamination stack height of the dynamoelectric machine for which the phase insulators are intended. Therefore, the phase insulator fabrication equipment, the take-up reel and the phase insulator insertion machine must be adapted to accommodate a variety of different phase insulator belt widths.

When a take-up reel is used to accumulate the belt of phase insulator windings for subsequent use in automated insulation insertion machines, it is important that the belt be properly wound on the machine with good alignment so that the insertion machine will not become jammed. The problem of providing good alignment of the belt as it is scrolled onto the take-up reel is aggravated somewhat when phase insulators using fused, filamentary cross-connector strips are employed since the belt, by necessity, is relatively loosely wound on the take-up reel. It is important that proper tensioning of the belt as it is wound onto the reel is employed to assure that one of the planer strips does not, in effect, move ahead of the other related planer strips which would result in skewing of the phase insulator on the take-up reel. Moreover, due to the loosely wound nature of the belt on the reel suitable tensioning must be employed to avoid internal skewing of the belt as the reel fills up. This again results from the fact that it is not possible to tightly pack the belt on the reel.

It is known in the prior art wherein take-up reels are used to accumulate lengths of processed sheet material to allow the material to form a loop of variable size, which is periodically taken up on the reel, by, for example, a start and stop drive mechanism. It is also known to provide a guide roll in the trough of the loop, for example, which is positioned at the end of a lever arm with the other end of the arm operating a position sensing and control mechanism to start and stop the take-up reel as the loop of material grows and contracts between maximum and minimum extended positions. This lever arm may sometimes be counterweighted to provide a certain degree of tensioning of the material to aid in the winding of the material on the take-up reel.

Such arrangements have not been found to be satisfactory for the purposes of operating take-up apparatus for the belt of phase insulators, such as fabricated by the equipment of the aforementioned application, Ser. No. 051,029.

It is therefore an object of the present invention to provide novel take-up apparatus for a continuous belt of fabricated phase insulators.

It is a more specific object of the invention to provide take-up apparatus of particularly beneficial use with fabricating equipment of the type disclosed in the aforementioned Burns and Wesseldyk application Ser. No. 051,029. More specifically, an object of the present invention is to provide novel take-up apparatus for equipment adapted to fabricate phase insulators, particularly of the type having cross-connector strips of filamentary material in which the phase insulators are in the form of a continuous belt of successive interconnected phase insulators; and wherein the belt is wound on the take-up apparatus with proper alignment such that the wound belt of phase insulators is suitable for subsequent use in an automated phase insulator insertion machine.

SUMMARY OF THE INVENTION

In carrying out the above and other objects in a preferred form of the invention, there is provided take-up apparatus for use in equipment for fabricating electrical phase insulators for dynamoelectric machines. The equipment for which the take-up apparatus of the invention is particularly adapted has exit guide means for supplying a continual belt of preformed phase insulators lying in a predetermined feed plane having a longitudinal feed axis. As provided from the fabricating equipment, the phase insulator includes spaced apart, parallel insulator strips moving at substantially equal relative feed rates with the insulator strips being interconnected by cross-connector strips to form substantially rectangular windows. Thus in accordance with the invention, take-up apparatus comprises a take-up reel spaced from the exit guide means of the fabricating equipment, the axis of rotation of the take-up reel being substantially parallel with the feed plane of the phase insulator belt and being substantially orthogonal to the longitudinal feed axis of the belt. The take-up apparatus further includes a guide roll having a phase insulator belt bearing surface with a longitudinal dimension parallel with take-up reel axis, the guide roll being positioned between the exit guide means and the take-up reel thus to form a downwardly depending loop of the phase insulator belt as the belt moves from the exit guide means to the take-up reel. In accordance with one particular aspect of the invention, an adjustable width, constant mass roll is provided which is adapted to be positioned within the trough of the phase insulator belt loop. The apparatus further includes means for alternately rotating the take-up reel at a low speed adapted to cause the length of the loop to grow toward a first extended position as the belt exits the fabricating equipment and at a higher speed adapted to cause the loop to contract toward a second retracted position. The apparatus finally includes sensing means responsive to the phase insulator belt loop for changing the rotational speed of the take-up reel between the low and high speeds when the loop reaches the first and second positions.

FIGS. *2a* and *2b* are plan and side views respectively of a single phase insulator construction useful in explaining the construction and operation of the present invention.

FIG. 3 is a side view of take-up apparatus constructed in accordance with one form of the present invention.

FIG. 4 is a perspective view of a phase insulator belt loop roll illustrating one feature of the present invention.

Figure 5:
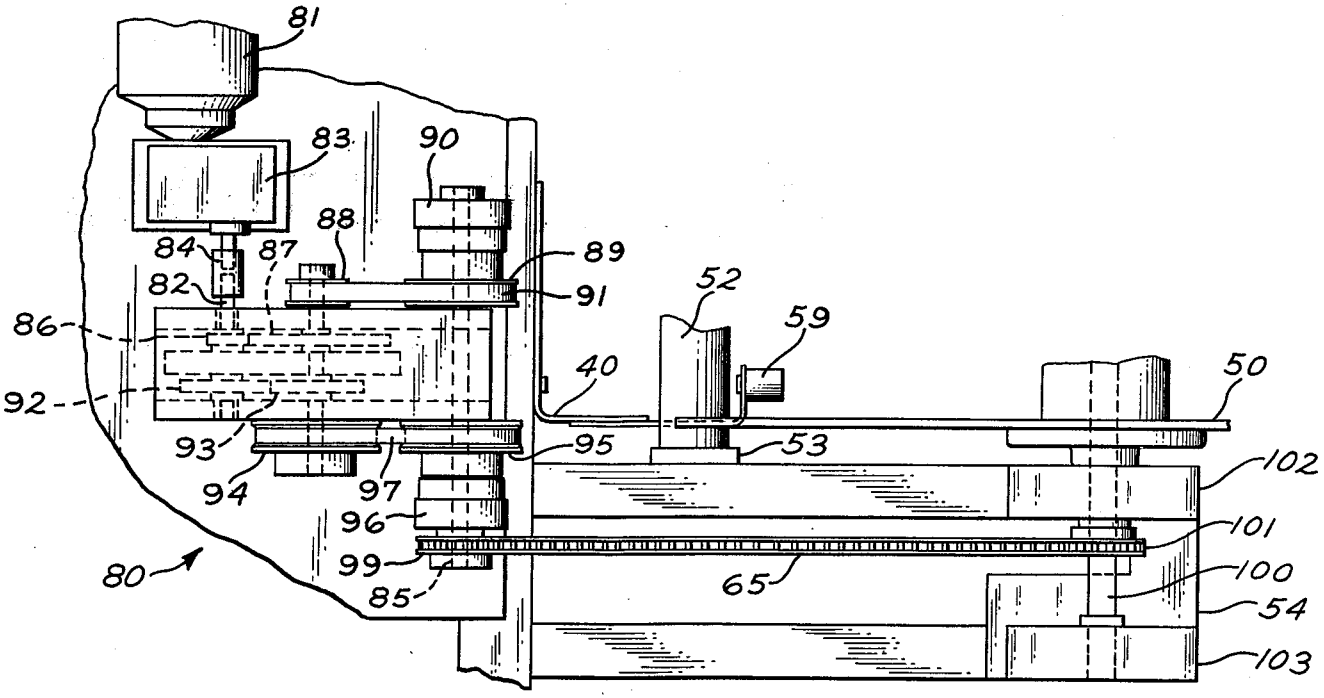

FIG. 5 is a partial plan view from the top of a drive mechanism featuring another aspect of the present invention and which is useful in the apparatus of FIG. 3.

DETAILED DESCRIPTION

Figure 1:
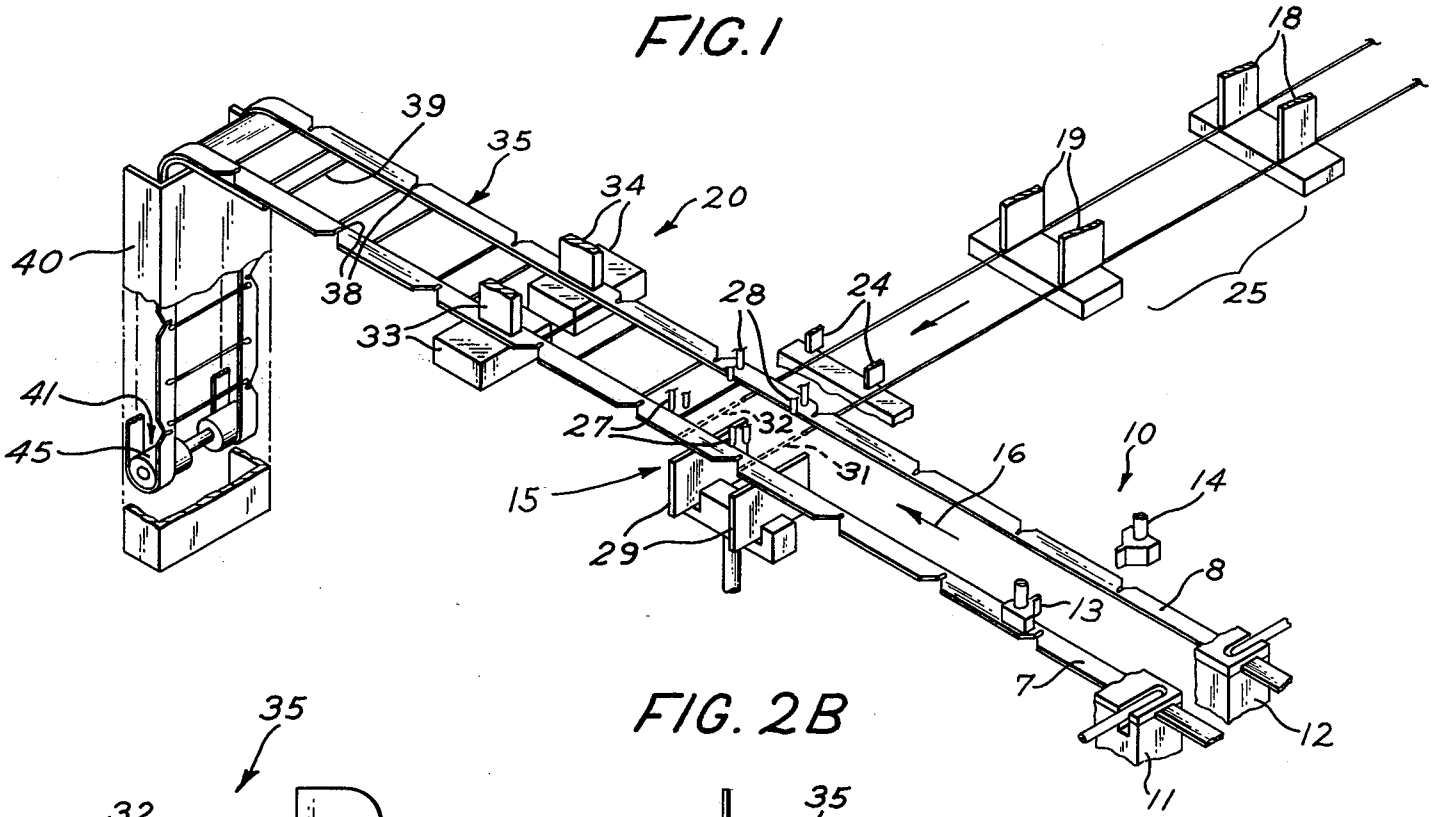
FIG. 1 is a perspective graphical representation of equipment for fabricating a continuous belt of phase insulators and showing a portion of the apparatus of the invention.
Figure 2B:
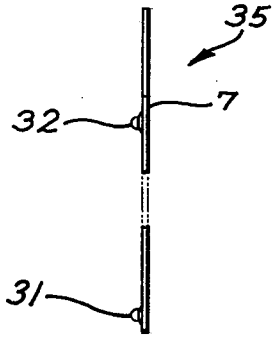
Figure 2A:
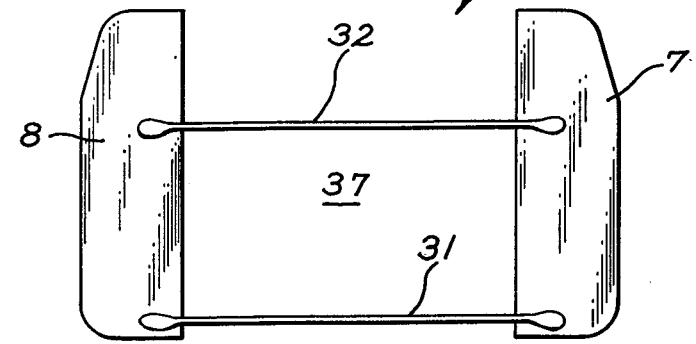

Referring now to FIG. 1, there is shown the principal stages involved in the fabrication of a continuous belt of longitudinally interconnected phase insulators which is to be accumulated on take-up apparatus of the present invention. As shown in FIGS. 1 and *2a, 2b,* each of the phase insulators 35 comprises oppositely disposed planar portions or strips 7, 8 interconnected by cross-connector strips 31, 32 which are secured to the planar portions by suitable means as will be explained. In FIG. 1, the phase insulators are shown longitudinally interconnected with each other by planar segments 38 which interconnect adjacent planar portions of the phase insulators to form a continuous belt of phase insulators. The planar segments allow the insulators to be accumulated or stored on a take-up reel 50 shown in FIG. 3. The segments are subsequently severed either manually or by automatic means to establish discrete phase insulators as shown in FIG. *2a* for placement into a dynamoelectric machine. The planar portions 7, 8 are formed from an insulating material such as, for example, polyethylene terephalate which may be purchased under the trade name "Mylar" marketed by E. I. DuPont de Nemours & Company. The connectors 31, 32 are also formed of an insulating material such as, for example, a filamentary or polyester monofilament material. For example, insulating material which has been utilized for the connectors has been a polyester monofilament material marketed as "Trevira" Grade T-960 by Hoechst Fibers Ind., a Division of American Hoechst Corporation having offices at 1515 Broadway at Astro Plaza, New York, N.Y. 10036. The thickness of the planar segments which has been used is approximately 0.0075 inches while the diameter of a monofilament material which has been used is approximately 0.042 inches.

Referring to FIG. 1, the two parallel disposed planar strips 7, 8 are fed from supply reels (not shown) through guide means 11, 12 along a longitudinal feed access represented by arrow 16 toward a securing station 15. The clamping units 33, 34 are provided with pneumatic means to periodically grip and move the planar strips 7, 8 in stepwise fashion through the fabricating stations. Cutters 13, 14 are operated to preform the strips into the desired length of phase insulator segments. When a phase insulator segment is positioned properly in the securing station 15, the cross-connector strips 31, 32 are moved into position on the underside of the strips by clamping and cutter bars 29. The cross-connector monofilament strips are fed from supply reels located at the side of the equipment by means of advancing blocks (not shown), through a stretching station 25 including clamp units 18 and 19, through a holding station represented by clamp units 24 to the securing station 15. The stretch station 25 is employed to remove any curvature set on the monofilament material resulting from storage on the supply reel.

When the cross-connectors 31, 32 and planar strips 7, 8 are in correct relative position within the securing station, the clamping and cutter bars 29 sever the cross-connectors 31, 32 and hold them in place on the underside of the planar strips 7, 8 while ultrasonic welding fingers 27, 28 are lowered to fuse the cross-connectors to the planar strips. At the conclusion of this step, the belt of phase insulator material is moved stepwise one position to allow formation of another phase insulator segment. In this manner, a continuous belt of phase insulators is formed which proceeds out of the fabrication equipment along an exit guide means or plate 39.

Referring to FIGS. 1 and 3, the belt of phase insulator segments proceeds out the exit of the fabrication equipment and, as such, lies in a feed plane which may be defined as the plane of the upper surface of feed plate 39 and along a longitudinal feed axis represented by arrow 16. After exiting the fabrication equipment, the belt of phase insulators 37 establishes a loop 41 between the take-up reel 50 and the exit plate 39 after being fed over a guide roll 52. Take-up reel 50 is spaced from the exit plate 39 by means of a mounting bracket 54 which is secured to the end of the fabrication equipment. In order to aid in assuring proper alignment of the belt of phase insulators on the take-up reel, the axis of rotation of take-up reel 50 preferably is established to be substantially parallel with the feed plane of the belt of phase insulators as it exits the fabrication equipment and also to be substantially orthogonal to the longitudinal feed axis of the belt of phase insulators in accordance with one aspect of the present invention. This alignment is advantageously maintained by means of the direct mounting of the feed roll to the structure of the fabrication equipment. In practice, a rotatable mounting axle 56 is secured by suitable bearing structure cantilever fashion to the mounting bracket 54 with take-up reel 50 being removable from the mounting axle 56. Guide roll 52 may comprise a fixed elongated cylinder mounted in cantilever manner by means of bracket 53 to support bracket 54. Guide roll 52 preferably includes a belt bearing surface having a longitudinal dimension which is parallel with the rotational axis of take-up reel 50. In accordance with another aspect of the present invention, an adjustable width constant mass roll or weight 45 is adapted to be positioned in the trough of loop 41 formed between exit guide plate 39 and guide roll 52. As shown in FIG. 4, loop weight 45 preferably comprises a grooved connector rod 49 either end of which is received in a pair of substantially equal weight rolls 47, 48. These end rolls 47, 48 are adapted to ride on the parallel planar strips 7, 8 of the continuous belt and may be positionally adjusted on the grooved connector rod 49 to match a variety of different widths of phase insulator belts being fabricated on the fabrication equipment. Spring plungers 44 are provided to hold the rolls 47, 48 securely in place once they are adjusted to the desired width. It will be appreciated that the length of each of the plungers is such that they are recessed within the threaded holes so as not to interfere with the smooth operation of the roll weight 45 on the surface of phase insulator strips 7, 8.

Take-up reel 50 is driven by a variable speed drive unit 80 which is interconnected with take-up reel 50 by means of drive chain 65. Loop position sensors including an upper photocell sensor 58 and light 59 and a lower photocell sensor 60 and light 61 are responsive to the positioning of the phase insulator belt loop 41 to cause drive unit 80 to vary the rotating speed of take-up reel 50 between a low and high speed of rotation. In an actually constructed embodiment, a low speed of one-half rpm and a high speed of two rpm was employed whereby the low speed allows the loop to grow to an extended position shown in solid outline in FIG. 3 until it reaches and blocks the light path between light 61 and sensor 60 whereupon the drive unit switches to the high speed of rotation permitting the loop 41 to retract to an upper position shown in dotted outline. When the loop retracts above the light path between light 59 and sensor 58, sensor 58 causes drive unit 80 to revert to the low speed of operation. Thus the two speed drive provides continuous rotation of the take-up reel 50 and thereby provides a relatively smooth take-up or accumulation of the phase insulator belt on the reel so as to minimize possible problems of distortion of the belt on the reel resulting from stopping and starting of take-up reel 50.

Referring to FIG. 5, further details of the drive unit for take-up reel will not be described. Thus a variable speed DC motor 81 is connected to drive shaft 82 by way of a speed reducer 83 and coupling 84. A low speed rotation of output drive shaft 85 is provided by interconnected gears 86 and 87, sprockets 88 and 89 and a low speed clutch 90. An initial reduction in speed is provided by driving engagement between the differently sized gears 86 and 87 and a still further reduction to the desired low speed value is provided by the differently sized sprockets 88 and 89 which are interconnected by timing belt 91. Actuation of the low speed clutch having the sprocket 89 connected thereto, causes engagement with the output shaft 85 for providing a low speed output. A high speed rotation of the output shaft is provided by interconnected gears 92 and 93, sprockets 94 and 95, and a high speed clutch 96. In the illustrated arrangement, the engaging gears 92 and 93 are of the same size, and the sprockets 94 and 95, which are interconnected by timing belt 97, are of the same size so as to provide an output speed for output shaft 85 which is the same speed as that of input shaft 82. Actuation of the high speed clutch 96 having the sprocket 95 connected thereto, causes engagement with the output shaft 85 for providing a high speed output. The output shaft 85 of the drive unit 80 is interconnected with reel shaft 100 for driving the take-up reel 50 by way of sprockets 99 and 101 and the chain 65, with bearing units 102 and 103 being provided for rotational mounting of the reel shaft 100. In a take-up unit fabricated in accordance with FIGS. 3 and 5, motor 81 was a General Electric one-twelvth horsepower shunt-wound 90 volt DC motor Model No. 5BN694A11 (1725 r.p.m.) with the speed thereof controlled by a Boston Ratiotrol speed control No. RPI-100; the reducer 83 was a Boston reducer No. TWF-109-200; the gears 86, 87, 92 and 93 were Boston Gear No. GA-20, GA-80, GA-50 and GA-50, respectively; the timing sprockets 88, 89, 94 and 95 were Morse Timing Belt Sprockets No. 12L050, 24L050, 28050, and 28050, respectively; the sprockets 99 and 101 were Boston Sprockets No. HKSA-18-1 with one-half inch and three-fourths inch bores, respectively; and the clutches 96 and 90 were warner clutches model EC-375 with a $\frac{5}{8}$ inch diameter through shaft and were operated by way of a Warner Control MSC-154-3.

Although the take-up apparatus of this invention is believed to be of general utility when employed with phase insulator fabricating equipment irrespective of whether the belt of phase insulators is made using the technique illustrated in FIG. 1 or using an alternative technique in which the phase insulators are stamped out of a solid belt of insulator material, the invention is believed to be particularly advantageous when used in connection with the technique of FIG. 1 in which filamentary cross-connecting pieces are employed.

When using filamentary cross-connectors it is necessary to wind the insulator belt on the take-up reel in fairly loose fashion which results in a greater likelihood that skewing of the belt will occur as it is wound on the reel 50. Moreover, even when the belt is initially wound in properly aligned manner on the reel 50, as the reel fills up if improper tension is applied to the belt as it is fed to the reel it is possible for the loosely wound belt on the reel to be internally skewed due to the increased leverage applied on the outer dimension of the wound belt. Thus with reference to the loop weight 45 illustrated in FIG. 4, it has been found empirically that a weight of approximately two pounds is most advantageous in the operation of the invention although empirical testing might result in a different weight being employed for take-up apparatus of a modified structure or involving a phase insulator material other than "Mylar." Moreover, having established a desired preferred weight for the roll 45 for a given take-up apparatus, it is desirable that a single roll be employed even though a variety of different belt widths may be fabricated by the fabrication equipment. Thus the threaded nature of the end weight pieces on roll 45 permits the weight to be adjusted in width to accommodate varying width belts without changing the preferred weight factor. Additionally, by employing a constantly rotating reel that rotates at high and low speeds, the adverse affect of skewing or misalignment of the belt which has been wound on the reel is minimized as compared with a reel which is brought to a full stop between take-up operations, that is to say, between periods when the take-up reel is driven to cause the loop to retract from its extended position to its uppermost retracted position.

It will be appreciated from the foregoing description that there has been disclosed a simple and economical phase insulator take-up apparatus that provides desired alignment of the phase insulator belt on the take-up reel and that it is particularly adapted to use with a phase insulator belt in which the phase insulator strips are cross-connected with filamentary material. The two speed drive of the take-up reel contributes effectively to maintaining good alignment of the belt on the take-up reel and the predetermined weight of a constant mass which is adjustable in width enables a variety of phase insulator belt widths to be fabricated with a constant weight applied to the belt loop and without the need for a multiplicity of weight rollers to accommodate the different belt widths.

While, in accordance with the patent statutes, there has been described what at present is considered to be a preferred embodiment of the invention, it will be obvious to those skilled in the art that various changes and modifications may be made therein without departing from the invention. It is, therefore, intended by the appended claims to cover all such changes and modifications as fall within the true spirit and scope of the invention.

What is claimed is:

1. In equipment for fabricating electrical phase insulators for dynamoelectic machines, the equipment having exit guide means for supplying a continuous belt of preformed phase insulators lying in a predetermined feed plane having a longitudinal feed axis, said phase insulators including spaced apart parallel insulator strips moving at substantially equal relative feed rates, the insulator strips being interconnected by cross connector strips to form substantially rectangular windows; take-up apparatus therefor comprising:

a take-up reel spaced from said exit guide means and having an axis of rotation substantially parallel with said feed plane and substantially orthogonal to said longitudinal feed axis;

a guide roll having a belt bearing surface with a longitudinal dimension parallel with the take-up reel axis and being positioned between said exit guide means and said take-up reel to form a downwardly depending loop of said insulator belt as the belt moves from the exit guide means to the take-up reel;

an adjustable width, constant mass roll adapted to be positioned within said loop;

drive means for alternatively rotating said take-up reel at a low speed adapted to cause the length of the loop to grow toward a first extended position and at a higher speed adapted to cause the loop to contract toward a second retracted position;

and sensing means responsive to said belt loop for changing the rotational speed of said take-up reel between said low and high speeds when the loop reaches said first and second positions.

2. Take-up apparatus according to claim 1 in which said constant mass roll comprises a pair of equal weight cylinders with threaded inner diameters and a connected rod having threaded ends onto which the pair of cylinders are threaded and means to secure the pair of weights on said rod at desired positions, the width of said roll being adjustable to match the width of the fabricated phase insulator belt, and the total combined weight of the cylinders and connected rod being a desired weight selected to provide a predetermined tension on the belt as it is rolled up onto the take-up reel.

3. Take-up apparatus according to claim 2 in which said combined weight of the cylinders and connecting rod is approximately two pounds.

4. Take-up apparatus according to claim 1 in which the sensing means causes the drive means to decrease the rotational speed of the take-up reel when the loop reaches the retracted position and to increase the rotational speed when the loop reaches the extended position.

5. Take-up apparatus according to claim 1 in which the drive means includes a motor drive, alternate slow speed and high speed gear trains connected to the motor drive, a pair of clutches, each independently connected to one of said gear trains, a drive shaft and chain drive connected to said take-up reel, said clutches being individually engageable with said drive shaft to alternately drive said reel at slow and high speeds; and in which said sensing means are electrically coupled to the clutches to alternately engage the clutches with the drive shaft.

6. Take-up apparatus of claim 5 in which said slow speed is approximately one-half r.p.m. and in which said high speed is approximately two r.p.m.

* * * * *